US006327728B1

(12) United States Patent
Hart

(10) Patent No.: US 6,327,728 B1
(45) Date of Patent: Dec. 11, 2001

(54) PAINTERS TOOL IMPROVEMENT

(76) Inventor: Timothy Gene Hart, 401 Tyler Ave., Evansville, IN (US) 47715-3243

( * ) Notice: Subject to any disclaimer, the term of this patent is extended or adjusted under 35 U.S.C. 154(b) by 0 days.

(21) Appl. No.: 09/606,989

(22) Filed: Jun. 29, 2000

Related U.S. Application Data

(60) Provisional application No. 60/141,425, filed on Jun. 29, 1999.

(51) Int. Cl.[7] ..... B44C 7/00
(52) U.S. Cl. ..... 7/105; 7/138
(58) Field of Search ..... 7/105, 138

(56) References Cited

U.S. PATENT DOCUMENTS

| | | | | |
|---|---|---|---|---|
| 1,550,894 | * | 8/1925 | Erickson | 7/105 |
| 4,984,489 | * | 1/1991 | Krauthamer | 81/121.1 |
| 5,720,063 | * | 2/1998 | Chacon | 7/105 |
| 5,870,786 | * | 2/1999 | Papadopoulos | 7/105 |
| 6,009,581 | * | 1/2000 | Davis et al. | 7/105 |

* cited by examiner

*Primary Examiner*—Joseph J. Hail, III
*Assistant Examiner*—Joni B. Danganan
(74) *Attorney, Agent, or Firm*—Mark Manley; George Morgan; Gary Price

(57) ABSTRACT

A painters tool comprising at least one aperture matching a spindle of a window cranking mechanism which permits the tool to be used as a wrench to rotate the spindle of a window cranking mechansims.

1 Claim, 6 Drawing Sheets

PAINTERS TOOL IMPROVEMENT

CROSS REFERENCES TO RELATED APPLICATION

Provisional Application for Pat. No. 60/141,425 of Jun. 29, 1999, with the same title, "Painters Tool Improvement" which is hereby incorporated by reference. Applicant claims priority pursuant to 35 U.S.C. Par. 119(e)(i).

Statement as to Rights to inventions made under Federally sponsored research and development Not applicable

BACKGROUND OF THE INVENTION

1. Field of the Invention

This invention relates to an improvement to a painters tool, known in the trade as a "5 in 1" tool, said improvement comprising at least one aperture allowing said tool to be used as a wrench to crank window mechanisms used to crank windows open or closed.

2. Background Information

Commercial buildings often have windows that are each opened and closed by a cranking lever that operates a spindle that operates a cranking mechanism. In new construction, window installation contractors typically do not add cranking levers to the spindles of the cranking mechanisms until after the painters are finished painting the windows. However, it is necessary for the painters to open and close the windows while painting the windows. Invariably, the painters use time consuming makeshift arrangements for cranking the window mechanisms in order to open and close the windows. Often, pliers are used, which tend to damage teeth on spindles upon which the cranking levers mount.

Painters often carry a tool in the trade known as a tool. It typically comprises a pipe scraper, a roll nap scraper or cleaner, a caulking tool, an all purpose scraper, and a paint can opener. It does not function as a cranking lever for cranking window cranking mechanisms.

As will be seen from the subsequent description, the preferred embodiments of the present invention is a convenience for a painter that overcomes the limitations and disadvantages of the prior art.

SUMMARY OF THE INVENTION

The present invention is an improvement to a painters tool known in the art as a "5 in 1" tool which comprises the addition of at least one aperature that permits said painters tool to be used as a cranking lever for cranking a window mechanism.

DESCRIPTION OF THE PREFERRED EMBODIMENTS

Figure 1:
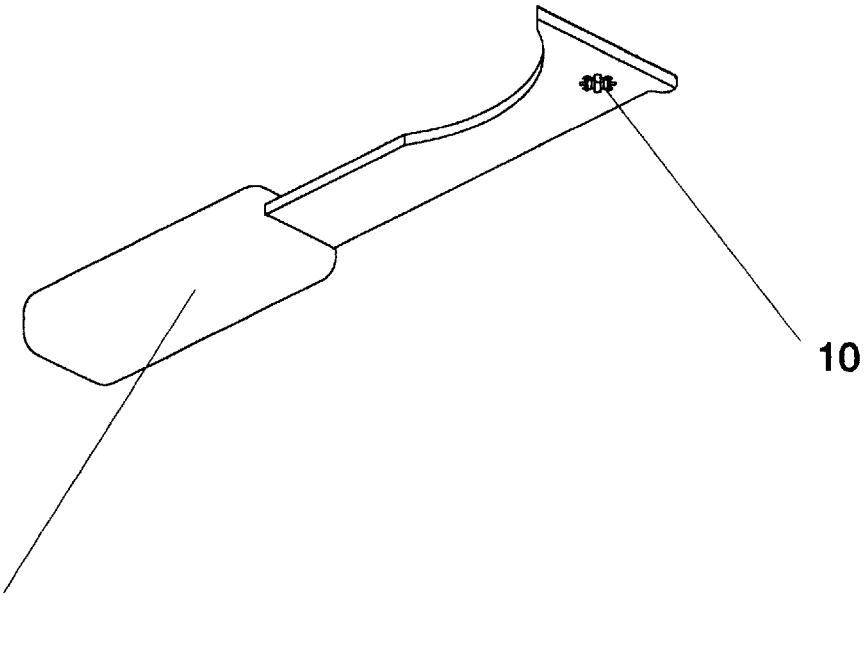
FIG. 1 illustrates the preferred embodiment of the present invention, a prior art painters tool known in the trade as a "5 in 1" tool modified with the addition of a cranking aperture.

FIG. 1 illustrates the preferred embodiment of the present invention, a painters tool improvement 1 comprising a cranking aperture 10. Said improvement 1 is a modification of a painters tool known in the trade as a "5 in 1" Painters tool.

Figure 2:
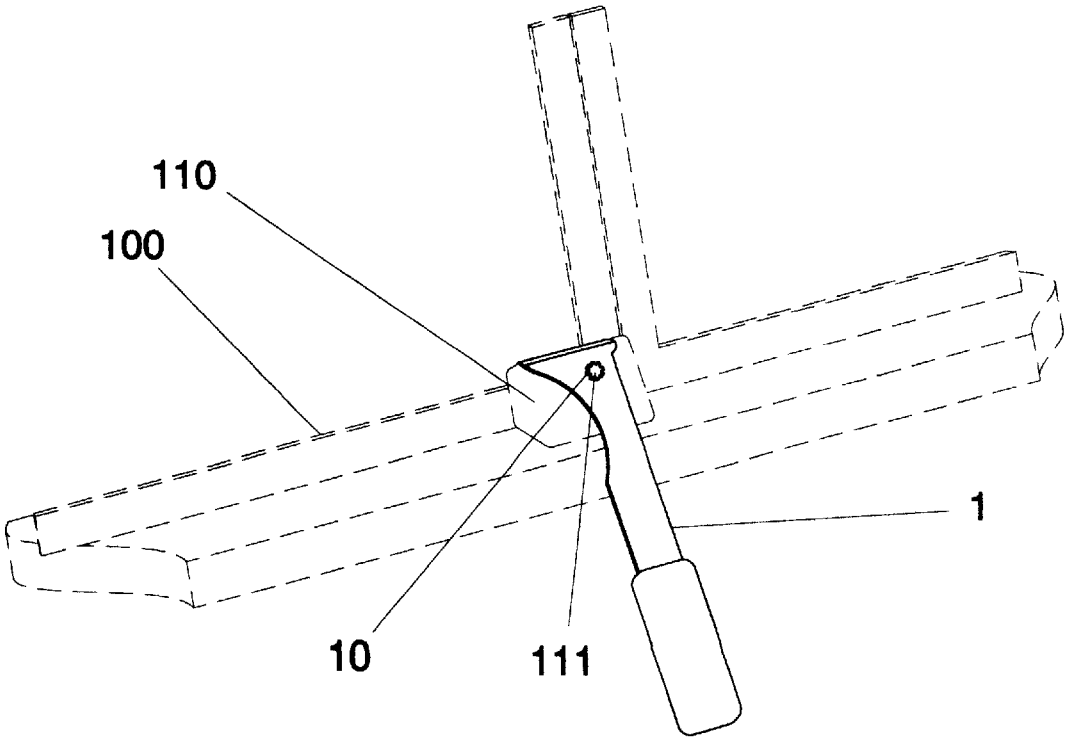
FIG. 2 illustrates an application of the preferred embodiment of the present invention.

FIG. 2 illustrates the painters tool improvement 1 applied to a prior art cranking spindle 111 of a prior art cranking mechanism 110 of a prior art window assembly 100. The painters tool improvement 1 enables an operator to rotate said spindle 111 which will actuate said cranking mechanism 110 to open or close said window assembly 100.

Figure 3:
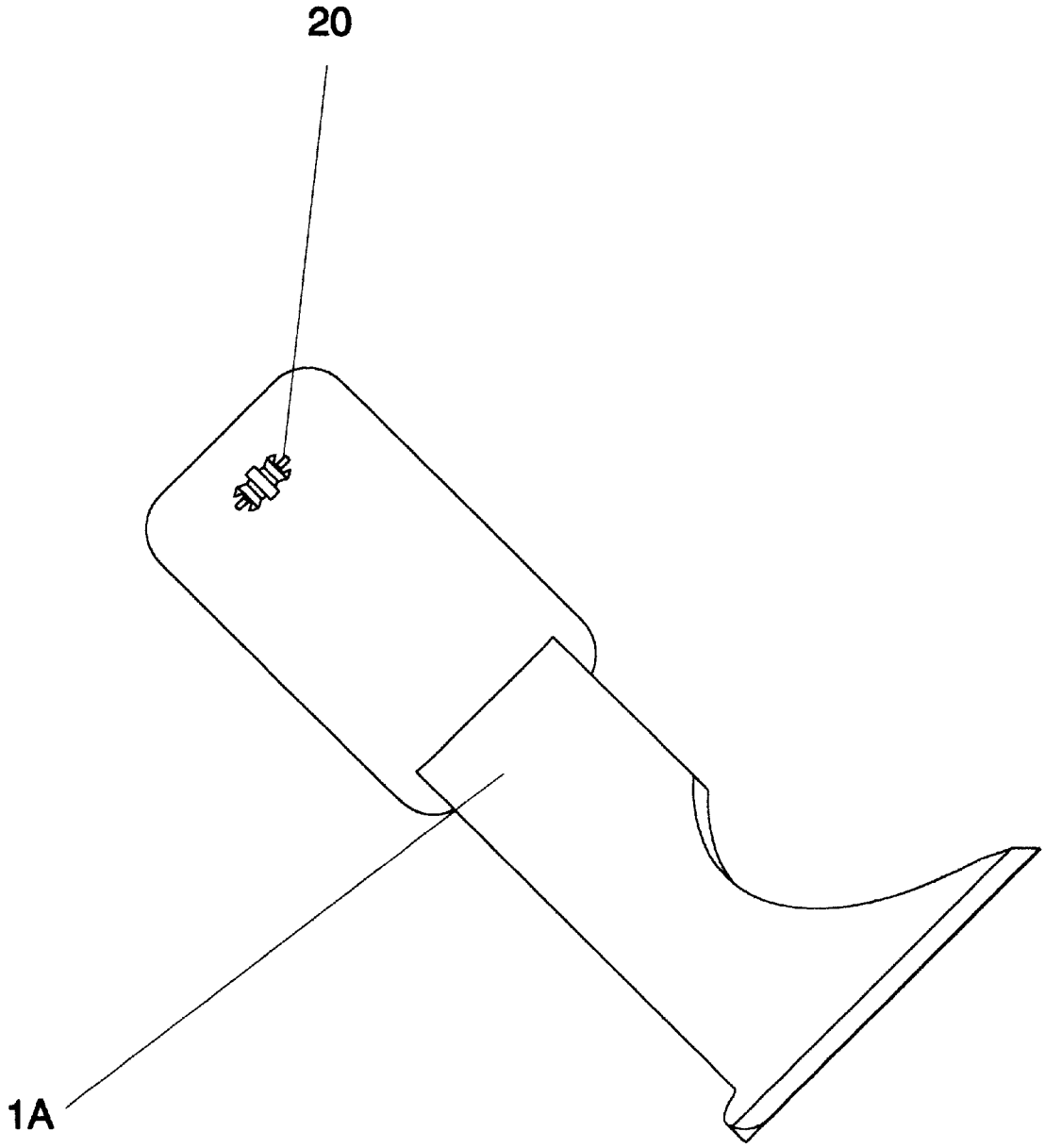
FIGS. 3–9 illustrate alternate embodiments of the present invention.

FIG. 3 illustrates an alternate embodiment of the present invention, an alternate painters tool improvement 1A comprising an alternate cranking aperture 20.

Figure 4:
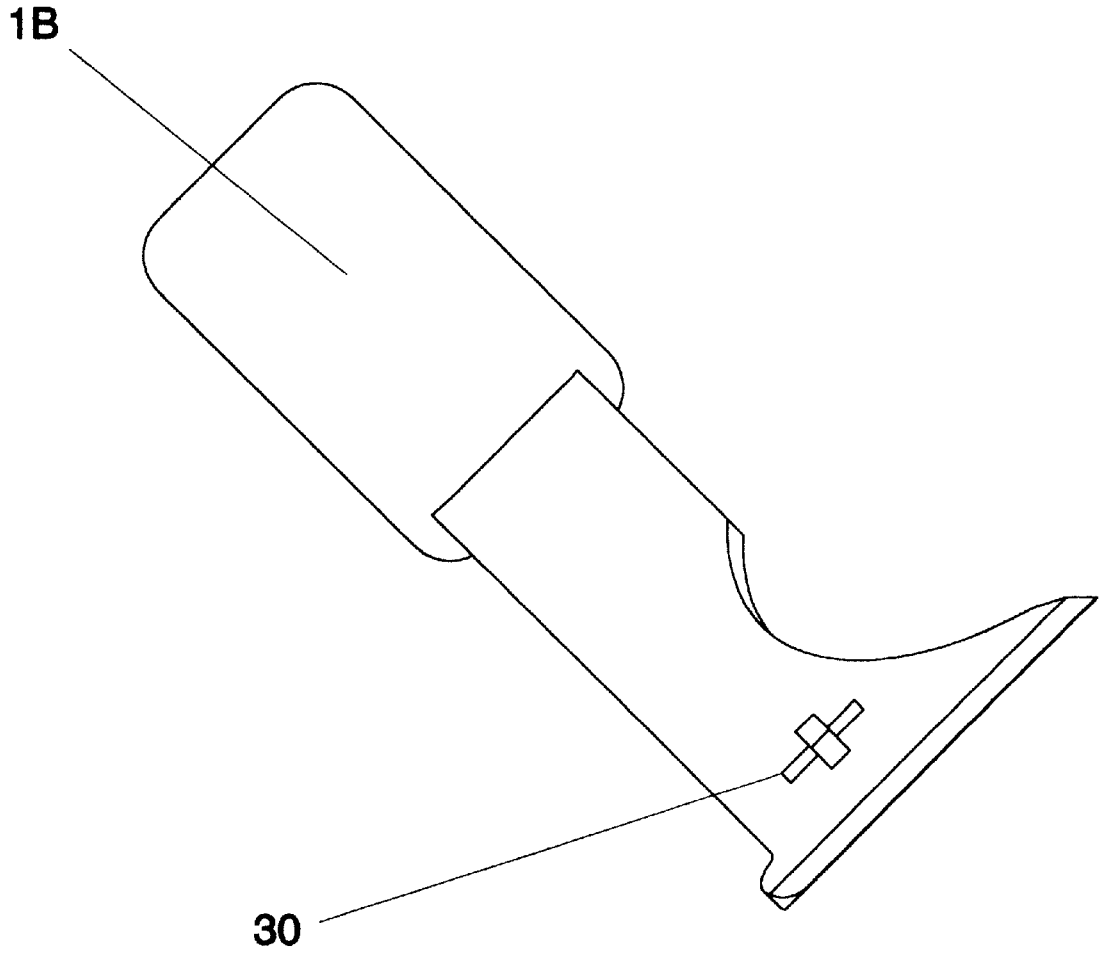

FIG. 4 illustrates a second alternate embodiment of the present invention, a second alternate painters tool improvement 1B comprising a second alternate cranking aperture 30.

Figure 5:
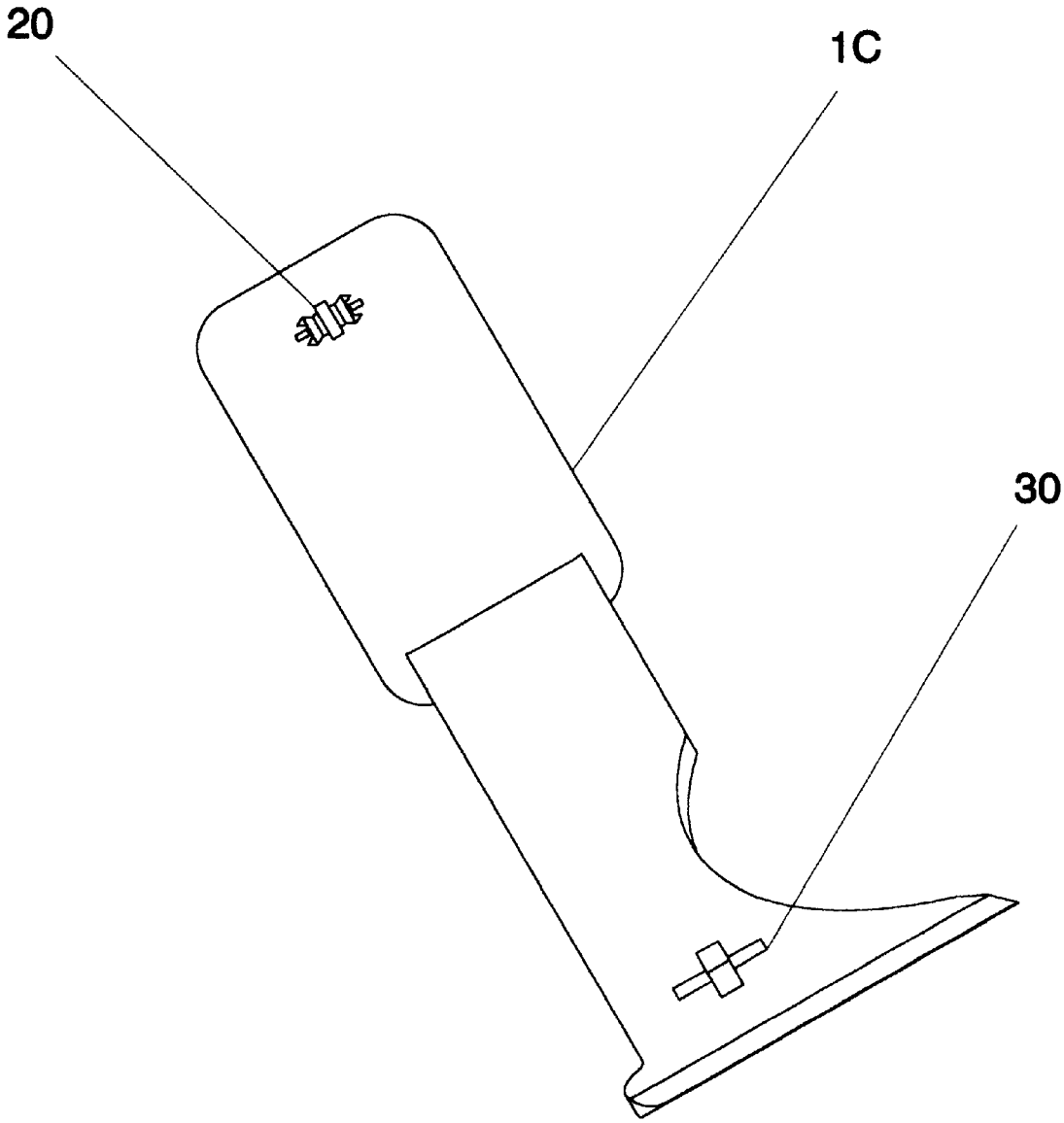

FIG. 5 illustrates a third alternate embodiment of the present inventions, a third alternate painters tool improvement 1C comprising the alternate cranking aperture 20 and the second alternate cranking aperture 30.

Figure 6:
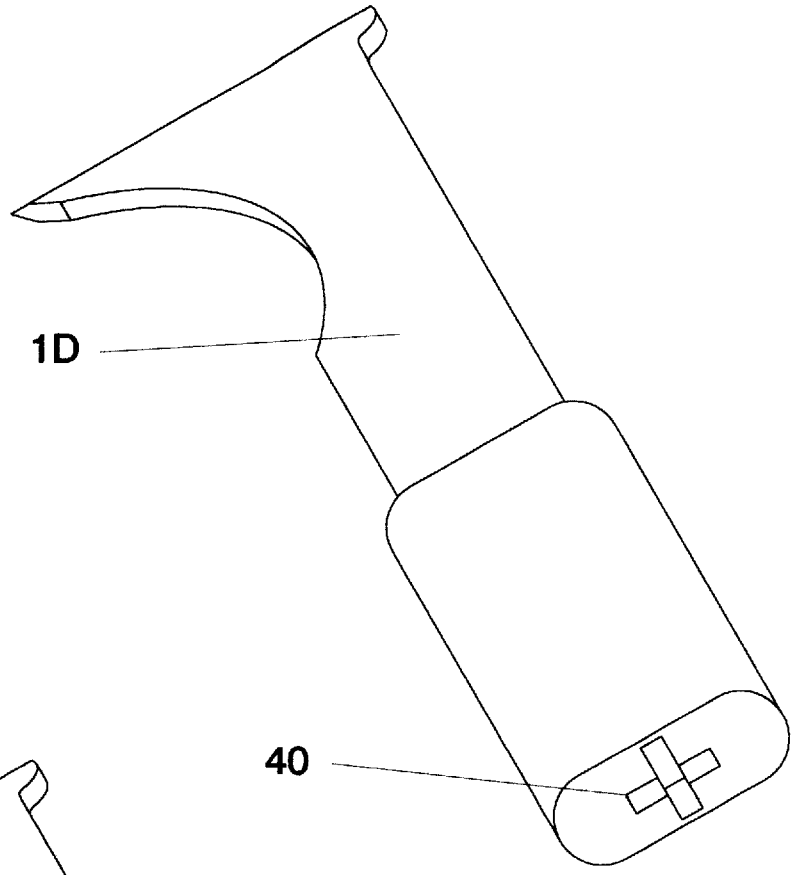

FIG. 6 illustrates a fourth alternate embodiment of the present invention, a fourth alternate painters tool improvement 1D comprising a third alternative butt end cranking aperture 40.

Figure 7:
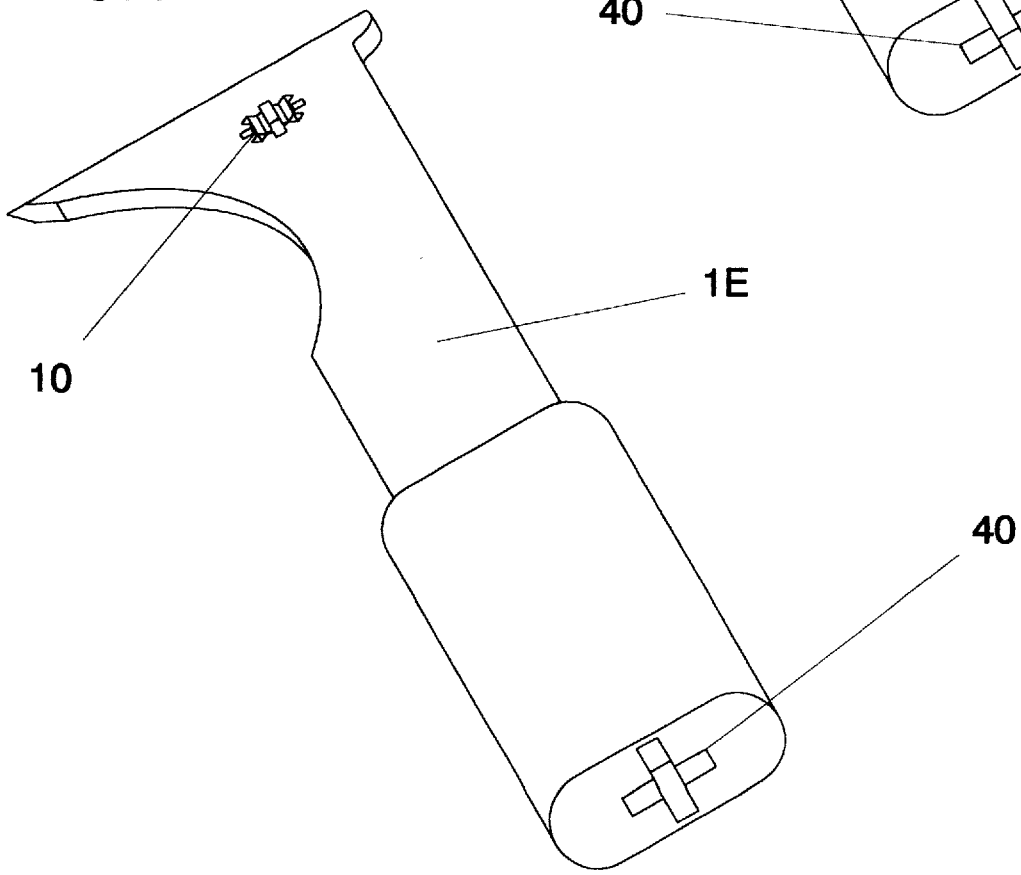

FIG. 7 illustrates a fifth alternate embodiment of the present invention, a fifth alternate painters tool improvement 1E comprising the cranking aperture 10 and the third alternative butt end cranking aperture 40.

Figure 8:
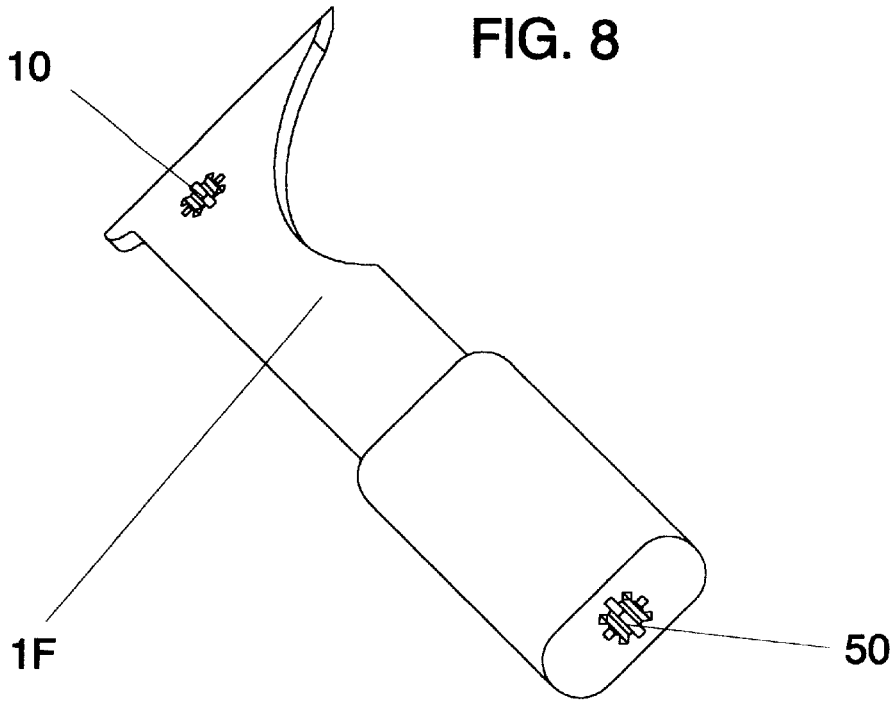

FIG. 8 illustrates a sixth alternate embodiment of the present invention, a sixth alternate painters tool improvement 1F comprising a cranking aperture 10 and a butt end cranking aperture 50.

Figure 9:
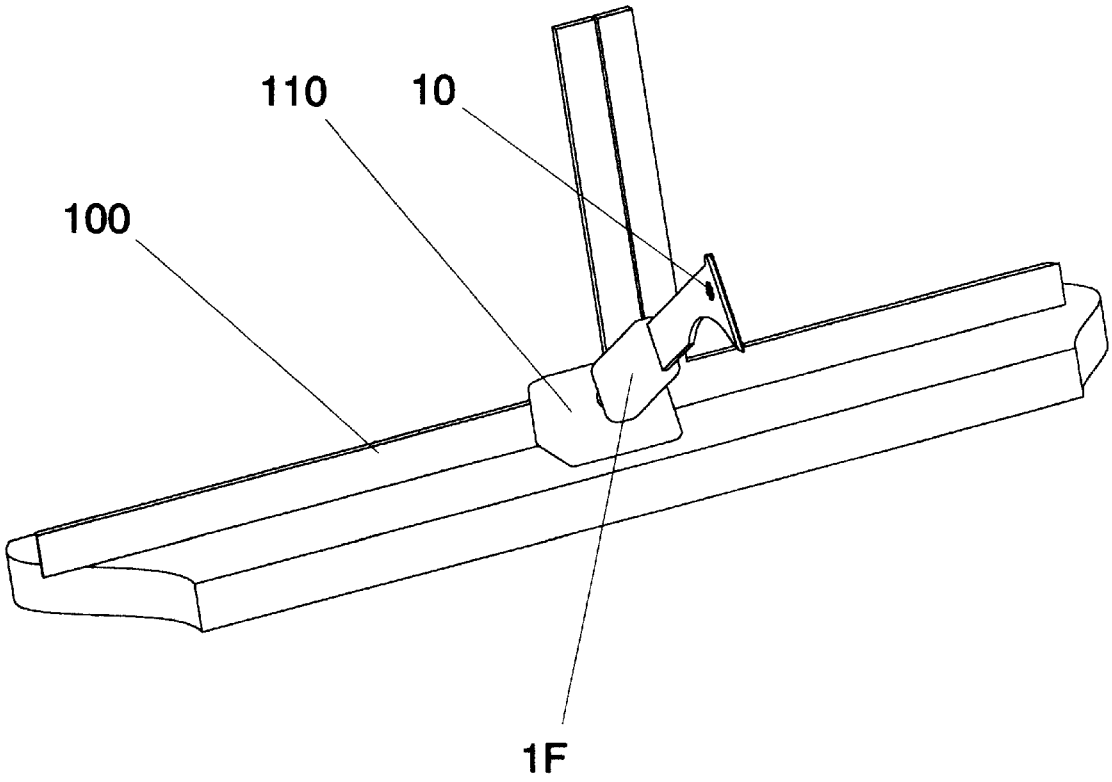

FIG. 9 illustrates the sixth alternate painters tool improvement 1F applied to rotate the cranking spindle 111 (Ref. FIG. 2) of the cranking mechanism 110 of the window assembly 100 to open or close the window assembly 100. The benefit of having both the cranking aperture 10 and the butt end cranking aperture 50 in the sixth alternate painters tool improvement 1F is that the cranking aperture 10 is located for maximum leverage in cranking the cranking spindle 111 for breaking loose the cranking mechanism (as shown in FIG. 2) while the butt end cranking mechanism 50 would be axially aligned with said cranking spindle 111 for rapid turning of said cranking spindle 111. This would be applicable in cases where relatively low torque is required. This is an especially desirable alternative in combination with any of the previously described cranking apertures, such as, but not restricted to, said apertures 10 or 20 because apertures 10 or 20 could be used to break free said cranking spindle 111 as shown in FIG. 2 and then the butt end cranking aperture 50 used to more rapidly rotate said cranking spindle 111.

Although the description above contains many specificities, these should not be construed as limiting the scope of the invention but as merely providing illustrations of some of the presently preferred embodiments of this invention.

For example, window assembly cranking spindles, in general, tend to match either said apertures 10, 20, and 50 or said apertures 30 and 40, so those configurations were chosen to illustrate the preferred embodiments of the present invention. Said apertures 10, 20, and 50 are star shaped, as opposed to said apertures 30 and 40 which are cross shaped. However, as obvious to anyone skilled in the art, other shapes of window assembly cranking spindles may be out there where a different shaped aperture might be required.

Also, the illustrations show various apertures at various ends of a modified painters tool. The various apertures could also be centered in said tool or even at the butt end of said tool.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A bladed tool comprising:

a flat plate forming a blade, said blade including an edge used for scraping;

a relatively long handle attached to the blade;

a first aperture passing through said blade near said edge, said first aperture including means to engage a rotatable cranking spindle for a casement window such that by engaging said cranking spindle with said first aperture, said cranking spindle can be rotated to open said window; and a second aperture perpendicular to said first aperture wherein said second aperture is located in said relatively long handle such that rotating said tool about the axis of said first aperture applies a relatively high torque to the cranking spindle and rotating said tool about the axis of said second aperture applies a relatively low torque to the cranking spindle.

* * * * *